US010507892B2

(12) United States Patent
Carter

(10) Patent No.: US 10,507,892 B2
(45) Date of Patent: Dec. 17, 2019

(54) BOAT SAFETY MECHANISM FOR BOARDING BOATS IN DOCKYARD

(71) Applicant: George Carter, Eau Claire, WI (US)

(72) Inventor: George Carter, Eau Claire, WI (US)

( * ) Notice: Subject to any disclaimer, the term of this patent is extended or adjusted under 35 U.S.C. 154(b) by 0 days.

(21) Appl. No.: 15/706,694

(22) Filed: Sep. 16, 2017

(65) Prior Publication Data

US 2018/0001966 A1 Jan. 4, 2018

(51) Int. Cl.

| | |
|---|---|
| ***B63B 21/00*** | (2006.01) |
| ***E02B 3/24*** | (2006.01) |
| ***B63B 21/08*** | (2006.01) |
| ***B63B 43/04*** | (2006.01) |

(52) U.S. Cl.

CPC ..... *B63B 21/08* (2013.01); *B63B 43/04* (2013.01)

(58) Field of Classification Search

CPC ..... B63B 21/00; B63B 21/08; B63B 2021/00; B63B 2021/003; B63B 43/00; B63B 43/04; B63B 2043/00; B63B 2043/04; B63B 2734/00; B63B 27/00; B63B 27/14; B63B 2027/00; B63B 2027/14

USPC ... 114/343, 362, 364, 230.1, 230.15, 230.16, 114/230.17, 230.18, 230.19

See application file for complete search history.

(56) References Cited

U.S. PATENT DOCUMENTS

| | | | | | |
|---|---|---|---|---|---|
| 2,964,767 | A * | 12/1960 | Egbert | B63B 27/14 | 14/71.1 |
| 3,571,836 | A * | 3/1971 | Dunlap | B63B 21/00 | 114/230.1 |
| 4,153,137 | A * | 5/1979 | Johnson | E06C 7/42 | 114/362 |
| 4,365,689 | A * | 12/1982 | Dever | E06C 9/08 | 182/106 |
| 4,538,314 | A * | 9/1985 | Baranowski | B63B 27/14 | 114/362 |
| 5,586,516 | A * | 12/1996 | Hagen | B63B 27/143 | 114/362 |
| 5,628,274 | A * | 5/1997 | Biedenweg | B63B 21/00 | 114/362 |
| 7,314,015 | B1 * | 1/2008 | Obahi | B63B 21/00 | 114/230.16 |
| 7,444,954 | B1 * | 11/2008 | Resta | B63B 27/143 | 114/362 |
| 2012/0248395 | A1 * | 10/2012 | Stark | E04F 11/1812 | 256/59 |

* cited by examiner

*Primary Examiner* — Daniel V Venne
(74) *Attorney, Agent, or Firm* — Barry Choobin; Patent 360

(57) ABSTRACT

The embodiments herein provide a tool for assisting users while docking a boat. According to an embodiment herein, a boarding aid mechanism for a boat for assisting a passenger while docking a boat includes a clamp, a vertical slide arm and a dock arm. The clamp is secured to one side of the boat. The vertical slide arm is mechanically coupled to the clamp using a pin. The vertical slide arm comprises a rubber handgrip for supporting and balancing the passenger. The dock arm is an L shaped structure extending from the vertical slide arm. The dock arm is slid into the vertical slide arm and further the vertical slide arm is secured to the clamp.

5 Claims, 5 Drawing Sheets

BOAT SAFETY MECHANISM FOR BOARDING BOATS IN DOCKYARD

BACKGROUND

Technical Field

The embodiments herein are generally related to a boat docking mechanism. The embodiments herein are more particularly related to a system and method for boarding and alighting boats safely. The embodiments herein are more particularly related to a boarding aid mechanism for assisting users in docking a boat.

Description of the Related Art

In the course of a boating experience, whether for recreational or commercial purposes, it is often necessary to secure a boat to a dock, wharf, pier or other land connected structure when the boat is no longer in use or is to be left unattended. Many boats have a home dock or slip where the owner or operator has made permanent accommodations for conveniently and safely tying up the boat. However, in many cases, a rider of a boat finds it necessary or desirable to tie up the boat at a temporary location. In such a case, they find that the dock cleats that are required to tie the boat are located in a wrong place/location, which is too far away, too few or even non-existent, thereby making it difficult and sometimes unsafe to secure the boat.

It well known to secure a boat to a dock by means of ropes and rubber fenders. However, the variation in water level at the dock at the result of the tide often yields undue stresses on the boat and/or the dock resulting in damage.

Existing mooring/docking devices helps in securing a rope or line around a remote object. However, it is typical of such prior art devices that they are quite complex in construction and operation, relatively expensive to manufacture, and often deficient in the measure of support which they provide for the users/passengers.

In the scenarios where a person gets into/off a boat, he might flip thereby hurting himself. Hence, there is need for a tool that helps the user in getting on/off a boat. Further there is requirement of a tool that assists the user in docking the boat.

Hence there is a need for a system and method to assist boat users to board and alight boat in a safe manner. Further there is a need for a boarding aid mechanism to assist a boat rider to enter/leave the deck of the boat safely. Still further there is a need for a boarding aid mechanism to dock the boats safely in a dock yard.

The above mentioned shortcomings, disadvantages and problems are addressed herein and which will be understood by reading and studying the following specification.

OBJECTS OF THE EMBODIMENTS

The primary object of the embodiments herein is to provide a tool for assisting users in docking a boat.

Another object of the embodiments herein is to provide a boat safety arm to press down the boat during a boarding time to make the boat stable.

Yet another object of the embodiments herein is to provide a boat safety arm with a clamp, vertical slide arm and dock arm.

Yet another object of the embodiments herein is to provide a boat safety arm to provide stability and support to a user, and to adjust deck level based on the height of the dock.

Yet another object of the embodiments herein is to provide a boat safety arm that is light weight and easy to install.

These and other objects and advantages of the embodiments herein will become readily apparent from the following detailed description taken in conjunction with the accompanying drawings.

SUMMARY

The various embodiments herein provide a tool for assisting users while docking a boat. According to an embodiment herein, a boarding aid mechanism for a boat for assisting a passenger while docking a boat is provided. The boarding aid mechanism includes a clamp, a vertical slide arm and a dock arm. The clamp is attached to the boat and is designed to secure to one side of the boat to a dock. The vertical slide arm is mechanically coupled to the clamp using a cotter pin (metal pin used to fasten two parts of a mechanism together). The vertical slide arm comprises a rubber handgrip for supporting and balancing the passenger. The vertical slide arm includes a plurality of holes for fixing the cotter pin. The dock arm is an L shaped structure extending from the vertical slide arm. According to an embodiment herein, the dock arm is slid into the vertical slide arm and further the vertical slide arm is secured to the clamp.

According to an embodiment herein the boarding aid mechanism for a boat is easy to install. Thus, a person does not need an assistant: while getting in and out of the boat. The clamp secures the boat with the dock. The vertical slide arm and dock arm are detached easily as boat leaves the dock. The vertical slide arms are extended (up to 42 inch) from side of boat and is used as a handhold to support the user getting in and out of boat.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of an illustration and not of a limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Although the specific features of the embodiments are shown in some drawings and not in others. This is done for convenience only as each feature may be combined with any or all of the other features in accordance with the embodiments.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a boarding aid mechanism for assisting users while docking a boat. According to an embodiment herein, a boarding aid mechanism for a boat for assisting a passenger while docking a boat includes a clamp, a vertical slide arm and a dock arm. The clamp is directly fastened to a gunwale side of one side of the boat. The vertical slide arm is mechanically coupled to the clamp using a pin. The vertical slide arm comprises a rubber handgrip for supporting and balancing the passenger. The dock arm is an L shaped structure extending from the vertical slide arm. The dock arm is slid into the vertical slide arm and further the vertical slide arm is secured to the clamp. The vertical slide arm includes a plurality of cotter pins (metal pin used to fasten two parts of a mechanism together).

According to an embodiment herein, the boarding aid mechanism for a boat is easy to install. Thus, a person does not need an assistant while getting in and out of the boat.

Figure 1A:
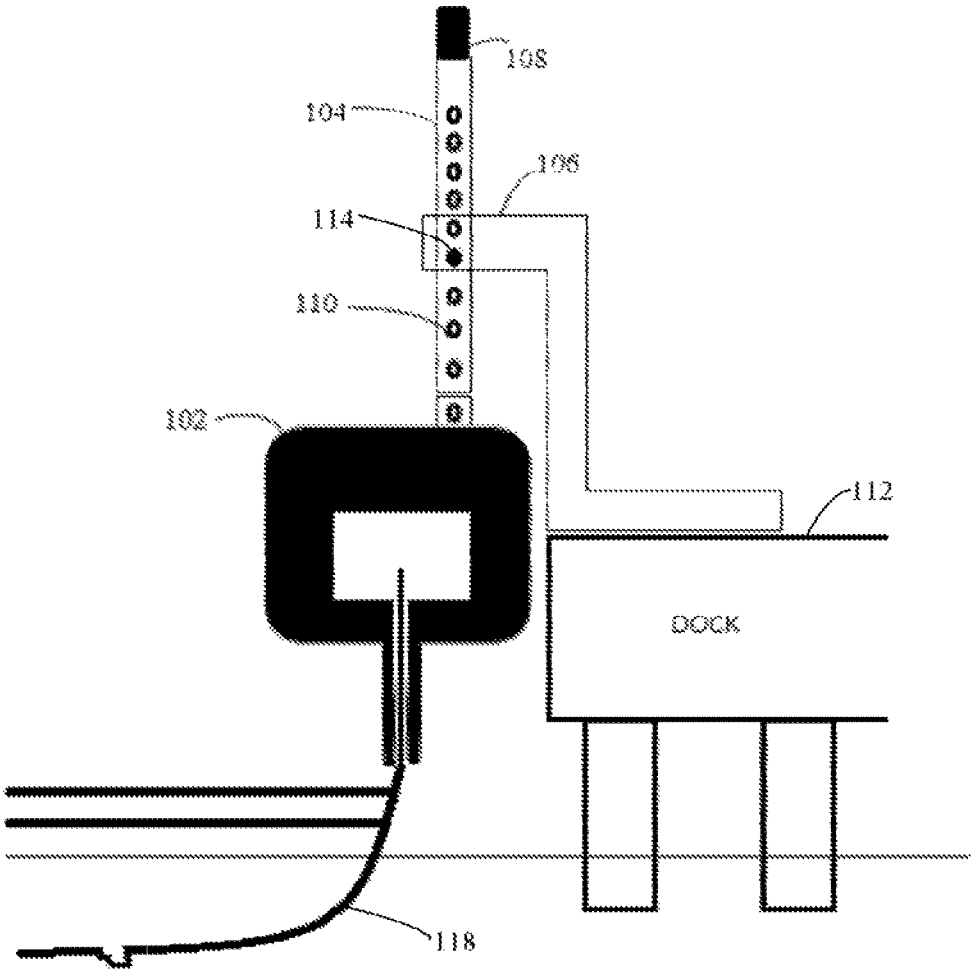
FIG. 1A illustrates a side view of a boarding aid mechanism for a boat, according to an embodiment herein.
Figure 1B:
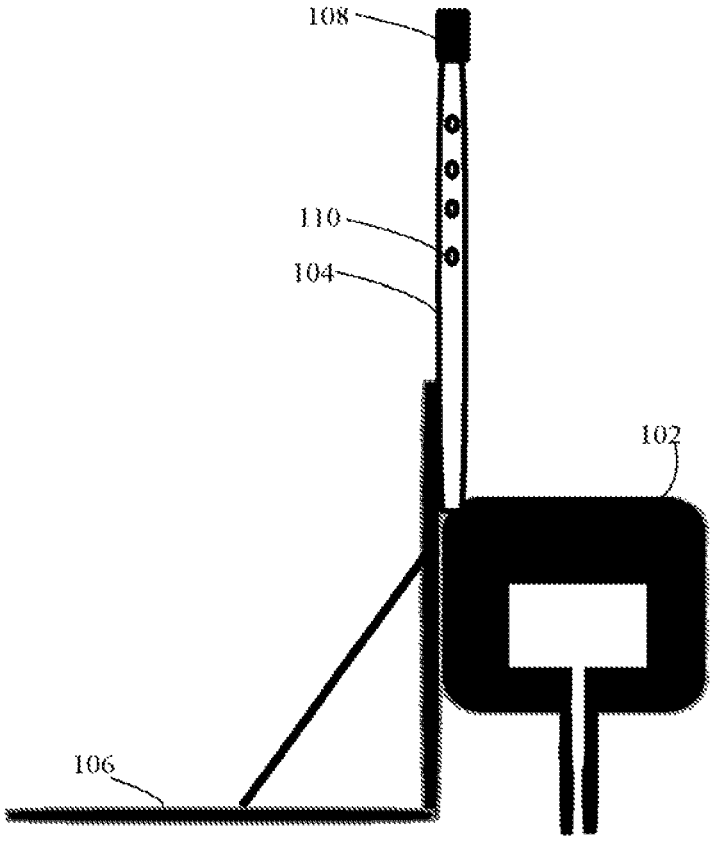
FIG. 1B illustrates a side view of a boarding aid mechanism for a boat, according to an embodiment herein.
Figure 1C:
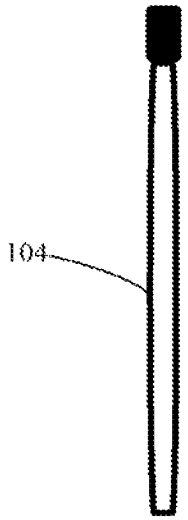
FIG. 1C illustrates a vertical slide arm in the boarding aid mechanism for a boat, according to an embodiment herein.
Figure 1D:
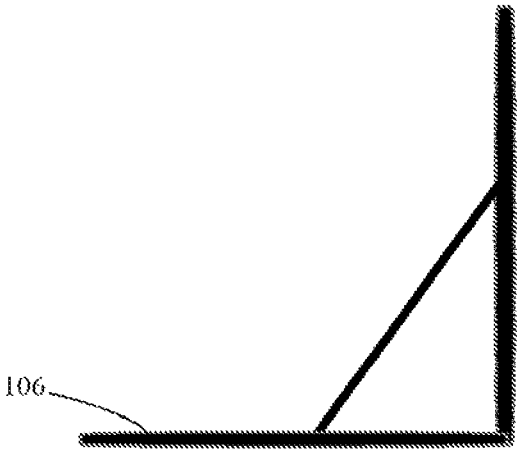
FIG. 1D illustrates a dock arm in the boarding aid mechanism for a boat, according to an embodiment herein.
Figure 1E:
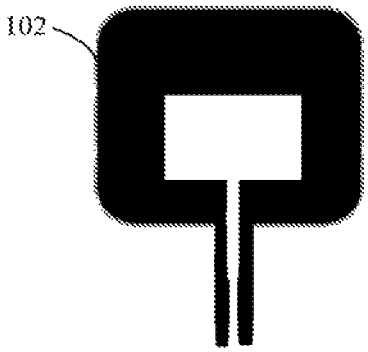
FIG. 1E illustrates a clamp in the boarding aid mechanism for a boat, according to an embodiment herein.

FIG. 1A illustrates a side view of a boarding aid mechanism for a boat according to an embodiment herein. FIG. 1B illustrates a side view of a boarding aid mechanism for a boat, according to an embodiment herein. FIG. 1C illustrates a vertical slide arm in the boarding aid mechanism for a boat, according to an embodiment herein. FIG. 1D illustrates a dock arm in the boarding aid mechanism, according to an embodiment herein. FIG. 1E illustrates a clamp in the boarding aid mechanism, according to an embodiment herein.

According to an embodiment herein, a boarding aid mechanism for the boat for assisting a passenger while docking a boat. With respect to FIG. 1A to FIG. 1E, the boarding aid mechanism for the boat includes a clamp 102, a vertical slide arm 104 and a dock arm 106. The clamp 102 is directly fastened to the gunwale side of the boat 118. The vertical slide arm 104 is mechanically coupled to the clamp using a pin. The vertical slide arm 104 comprises a rubber handgrip 108 for supporting and balancing the passenger. The rubber handgrip 108 provides a user with a steady grip while getting on/off the boat 118. The dock arm 106 is an L shaped structure extending from the vertical slide arm. The dock arm 106 is slid into the vertical slide arm 104. Further, the vertical slide arm 104 is secured to the clamp 102 using cotter pin. The vertical slide arm 104 includes a plurality of holes 110 to affix the cotter pin 114 (metal pin used to fasten two parts of a mechanism together).

According to an embodiment herein, the boarding aid mechanism for the boat is easy to install. Thus, a person does not need an assistant while getting in and out of the boat. The clamp is secured to the boat and detached from the boat using hex bolts. The vertical slide arm and the dock arm are easily detachable when boat leaves the dock. Further, the vertical slide arm and the dock arm are placed in the boat after detaching from the dock 112. The vertical slide arms extend up to 42 inch from side of boat and are used as a handhold to support self when getting in and out of boat. The weight of the boarding aid mechanism is 4 lbs. The boarding aid mechanism is made of aluminum material that is light weight and does not rust.

According to an embodiment herein, the L shaped dock arm is enabled to slide along the vertical slide arm to adjust the height of the dock arm depending on the height of the dock. Further, the L shaped dock arm is positioned on the vertical slide arm at a required height by fixing cotter pin into the hole present in the vertical slide arm.

The embodiments herein provide a tool for assisting users in docking a boat. The embodiments provide a boarding aid mechanism that is pressed down a boat to make the boat stable. The boarding aid mechanism for the boat provides a clamp that can be fastened to the boat. The boarding aid mechanism for the boat provides a vertical slide arm to offer stability and support to the user. The boarding aid mechanism for the boat provides a dock safety arm whose height can be adjusted based on the height of the dock. The boat safety arm is light weight and easy to install.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modifications.

Although the embodiments herein are described with various specific embodiments, it will be obvious for a person skilled in the art to practice the embodiments herein with and without modifications.

What is claimed is:

1. A boarding aid mechanism for a boat for assisting a passenger while docking the boat, comprising:

a clamp for securing one side of the boat to a dock and wherein the clamp is directly fastened to a gunwale side of the one side of the boat;

a vertical slide arm mechanically coupled to the clamp using a cotter pin, wherein the vertical slide arm comprises a rubber handgrip for supporting and balancing the passenger, and wherein the vertical slide arm includes a plurality of holes for fixing the cotter pin;

a dock arm extending from the vertical slide arm, and wherein the dock arm is attached to the vertical slide arm using the cotter pins, and wherein a height of the dock arm is adjusted corresponding to a height of the dock, and wherein the dock arm is configured to slide into the vertical slide arm to adjust the height of the dock arm to a required height depending on the height of the dock and wherein the dock arm is designed in a L shape and wherein the dock arm is positioned on the vertical slide arm at the required height by fixing the cotter pin into a hole on the vertical slide arm.

2. The boarding aid mechanism as claimed in claim 1, wherein the vertical slide arm includes a plurality of holes for attaching cotter pins.

3. The boarding aid mechanism as claimed in claim 1, wherein the dock arm is configured to slide into the vertical slide arm.

4. The boarding aid mechanism as claimed in claim 1, wherein the vertical slide arm and the dock arm are configured to be detached.

5. The boarding aid mechanism as claimed in claim 1, wherein the clamp is attached and provided at one side of the boat.

* * * * *